US006333683B1

(12) United States Patent
Hampel

(10) Patent No.: US 6,333,683 B1
(45) Date of Patent: Dec. 25, 2001

(54) REFLECTION MODE PHASE SHIFTER

(75) Inventor: Karl Georg Hampel, New York, NY (US)

(73) Assignee: Agere System Optoelectronics Guardian Corp., Allentown, PA (US)

( * ) Notice: Subject to any disclaimer, the term of this patent is extended or adjusted under 35 U.S.C. 154(b) by 0 days.

(21) Appl. No.: 09/148,442

(22) Filed: Sep. 4, 1998

(51) Int. Cl.[7] ..... H01P 1/18

(52) U.S. Cl. ..... 333/161; 333/160; 333/156; 333/164; 333/263

(58) Field of Search ..... 333/156, 159, 333/160, 161, 164, 263, 22 R, 139, 245

(56) References Cited

U.S. PATENT DOCUMENTS

| | | | | |
|---|---|---|---|---|
| 2,463,415 | * | 3/1949 | Nims, Jr. | 333/263 |
| 2,557,686 | * | 6/1951 | Rado | 333/263 X |
| 3,423,699 | * | 1/1969 | Hines | 333/160 X |
| 3,768,045 | * | 10/1973 | Chung | 333/164 |
| 4,187,480 | | 2/1980 | Frazita | 333/161 |
| 4,602,227 | * | 7/1986 | Clark et al. | 333/263 X |

FOREIGN PATENT DOCUMENTS

| | | | | |
|---|---|---|---|---|
| 117301 | * | 7/1984 | (JP) | 333/164 |
| 61-234102 | | 10/1986 | (JP) . | |
| 9-232801 | | 7/1997 | (JP) . | |

OTHER PUBLICATIONS

T. Moreno, *Microwave Transmission Design Data,* Dover Publ., New York, N.Y., 1948, Title page & pp. 104 & 106 cited.*

Nakahara et al.: "A Multiu Phase–State MMIC Phase Shifter" IEICE Transactions on Electronics, JP, Institute of Electronic Information and Comm. Eng. Tokio, vol. E79–C No. 5, May 1. 1996.

* cited by examiner

*Primary Examiner*—Benny T. Lee
(74) *Attorney, Agent, or Firm*—Gibbons, Del Deo, Dolan, Griffinger & Vecchione

(57) ABSTRACT

The invention is a mechanically or electro-mechanically driven phase shifter for radio frequencies. It is a device for phase shifting a signal propagating through a transmission line by moving a conductive construct between an active line and a ground plane of the transmission line. The conductive construct capacitively couples with either the active line and/or the ground plane, forming a capacitive shunt that reflects a significant part of the signal. The remaining portion of the signal is reflected at a terminated end of the transmission line, resulting in substantially no signal loss. The reflectance of the conductive constructs is determined by its capacitance to active line and ground, by its length, and by the step in the field-distribution at the interface between air-suspended and sledge-suspended sections. Design alterations are possible that enhance one or several of these effects, such as capacitance enhancement by dielectric coating of the sledge, any length variation, multiple sledge structures, modifications of the sledge cross-section etc. Further, a restriction to usage of only one sledge is also possible. A common driving mechanism is used when using multiple conductive constructs. The phase shifter is used in conjunction with signal separation circuits that separate incoming and reflected outgoing signals.

39 Claims, 17 Drawing Sheets

REFLECTION MODE PHASE SHIFTER

RELATED APPLICATIONS

The present patent application is related to U.S. patent application Ser. No. 06/097,267, entiled, "PHASE-TUNABLE ANTENNA FEED NETWORK", issued, August 2,000, and having a common inventor and assignee and being incorporated herein by reference.

FIELD OF THE INVENTION

The present invention relates to telecommunications, and in particular to phase shifters used for antenna beam steering.

BACKGROUND OF THE INVENTION

Beam steering has a number of applications. Of major significance is its application to the field of telecommunications. The geographic area serviced by a wireless telecommunications system is partitioned into a number of spatially-distinct areas called "cells." Each cell usually has an irregular shape (though idealized as a hexagon) that depends on terrain topography. Typically, each cell contains a base station, which includes, among other equipment, radios and antennas that the base station uses to communicate with wireless terminals in that cell. Due to instantaneous geographic variations in communications traffic, it may be desirable, at times, to adjust the geographic coverage of a particular base station. This can be accomplished by beam steering.

The free-space distribution of the electromagnetic signal, radiated by a base station antenna, is determined by the antenna radiation pattern. This antenna radiation pattern is usually characterized by one main lobe and several side lobes in the azimuth and elevation planes. In most cases, it is desirable to have a very narrow main lobe, also called an "antenna beam", in one or both angular dimensions. The advantage is that a narrow antenna beam is very directive, and the angular power density in the main lobe is very high. The enhancement of main-lobe power density with shrinking beam width is also called "antenna gain".

If the beam width of an antenna is very small, it becomes sensitive to proper physical adjustment. This is important because it is often necessary to change the angular position of the antenna beam ("beam steering") or to modify the entire radiation pattern of an antenna over time ("beam shaping", e.g., change of beam width etc.). All this makes implementation of remote beam steering/beam shaping capabilities into an antenna panel favorable.

A high-gain antenna (i.e. narrow beam) usually consists of an array of radiating antenna elements implemented into a flat panel array. The flat panel further incorporates a feed network that distributes the radio frequency ("RF") power to the radiating elements. The number of array elements in each physical dimension translates into antenna gain in the corresponding angular dimension. The more elements and the higher their spacing, the higher the maximum gain achievable, i.e., the smaller the beam width. The final beam form and position of such an array can be adjusted by varying the relative signal amplitude and signal phase of all radiating elements. In most cases, however, it is sufficient, to only tune the signal phase in each radiating element. Such a signal-phase adjustment can be accomplished by implementing phase shifters into the signal lines to the radiating elements or into the feed network.

The appropriate phase shifter design depends on the type and application of the particular antenna. In telecommunications, the highly competitive market demands low-cost solutions of small size. The lack of cost intensive hermetic enclosures in the outdoor environment further requires high stability against varying weather conditions, temperature cycling, moisture, and corrosion. Moreover, compatibility with high power levels is required (up to 200 W average per antenna panel). This further means high linearity with respect to the RF-signal power. For passive devices, very low insertion loss is required.

In principal, since the phase of a traveling wave in a transmission line can be adjusted by several independent parameters, there are several approaches for realizing phase shifters for radio frequencies. The change in phase $\phi$ experienced by an electromagnetic wave of frequency $f$ propagating with a velocity v through a transmission line of length L is given by the expression:

$$\phi=2\pi f L/c_{tr},$$

where $f$ is the signal frequency, $c_{tr}$ the propagation velocity in the transmission line, and where $c_{tr}$ is determined by:

$$c_{tr}=c_o/(\epsilon_{eff}\mu_{eff})^{1/2},$$

and where $c_o$ is the vacuum velocity of light, and $\epsilon_{eff}$ and $\mu_{eff}$ are the effective dielectric constant and magnetic permeability of the propagation medium, respectively. The signal phase $\phi$ can therefore be changed by either altering L, $\epsilon_{eff}$ or $\mu_{eff}$. Further, variable inductors or capacitors can be implemented into the line, which allows phase adjustment due to their variable reactance.

There are various designs of phase shifters known that exploit one or more of these effects One type of phase shifter utilizes switchable delay lines with different lengths. Such phase shifters are big, heavy, and expensive. Further, only discrete steps in the phase shift are possible. A second type of phase shifter, called line-stretcher phase shifters, utilize coaxial transmission line that are extendable in a telescope-type fashion. This, however, requires sliding-contacts and is therefore very sensitive to corrosion.

A third type of phase shifter uses solid state electronics such as varactor diodes. These are not, however, compatible with high power levels due to inherent nonlinearities. Active solid state solutions require power amplifiers on the tower-top, which are big, heavy, and expensive. Solid state solutions are, for the most part, only practical for receive antennas where the power levels are very small.

Phase shifters using Ferri-magnetic materials ("Ferrites") utilize the change of $\mu_{eff}$ by applying a direct current magnetic field. They are large, heavy and expensive. More recently developed thin-film techniques are much lighter, but they are nonlinear at high power levels. There are also phase shifters that use the mechanical motion of dielectric material into the electrical field lines. The effective relative phase shift is very small for materials with low dielectric constants leading to large-sized phase shifters. For high-dielectric materials, a significant impedance mismatch occurs at the interface to the dielectric loaded region, which causes an undesirable return loss. Solutions with high dielectric materials are further prone to power loss into dielectric resonance modes. As such, all of the prior art solutions have drawbacks that make them unsuitable for a implementation in telecommunications.

SUMMARY OF THE INVENTION

The invention is a mechanically or electro-mechanically driven phase shifter for radio frequencies. It is a device for phase shifting a signal propagating through a transmission line by moving a conductive construct, which is also referred to as a sledge, between an active line and a ground plane of the transmission line. The conductive construct capacitively couples with the active line and with the ground plane, forming a capacitive shunt that reflects a significant part of the signal. The remaining portion of the signal is reflected at a terminated end of the transmission line, resulting in substantially no signal loss. By moving the conductive construct along the line, the total reflected signal is phase shifted. The invention can be implemented using air-suspended or board suspended stripline, microstrip, or coplanar waveguide transmission-line structures or any other quasi-TEM transmission-line structure.

The reflectance of the conductive constructs is determined by its capacitance to active line and ground, by its length, and by the step in the field-distribution at the interface between air-suspended and sledge-suspended sections. Design alterations are possible that enhance one or several of these effects, such as capacitance enhancement by dielectric coating of the sledge, any length variation, multiple sledge structures, modifications of the sledge cross-section etc. Further, a restriction to usage of only one sledge is also possible.

The reflection-mode phase shifter can be connected to any isolation device such as a circulator, coupler or quadrature hybrid circuit that can separate incident and reflected waves. Importantly, it can be implemented with the same transmission-line structure. The invention imparts relatively large phase shift using small physical space and transmission-line length. Very small motion forces are required. It operates at high power levels, has very high linearity and very low insertion loss. Advantageously, it has high electrical and mechanical stability to temperature cycling, moisture and corrosion. Importantly, it can be used for electrical beam steering and is therefore of high value in wireless communications. Specifically, the noted features make this phase shifter an attractive component for implementation into flat panel antennas, especially when high power levels are used and low insertion loss is required. The phase shifter can further be used in many other applications.

BRIEF DESCRIPTION OF THE FIGURES

For a better understanding of the present invention, reference may be had to the following description of exemplary embodiments thereof, considered in conjunction with the accompanying drawings, in which.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

Phase shifters designed in this specification are used in conjunction with a transmission line that includes at least one signal-carrying ("active") line and at least one ground plane. As used herein, the term "transmission line" refers to quasi-transverse electromagnetic (TEM) transmission lines. For wireless telecommunications applications, typically in the range of about 0.5 to 50 gigahertz (Ghz), quasi-TEM transmission lines, such as a microstrip or stripline are usually employed. For sake of brevity, most illustrative embodiments of the present description show a phase shifter used in conjunction with a stripline. It should be understood, however, that in some embodiments, phase shifters in accordance with the invention are used in conjunction with microstrip or coplanar waveguides. Regardless of transmission line configuration, in some embodiments, the active line is advantageously air-suspended (i.e., no dielectric material is disposed between the active line and ground). Among any other benefits, such air-suspension reduces signal loss and allows an easy implementation of the proposed reflection-mode phase shifter.

Principal Concept of Reflection Mode Phase Shifter

Figure 1A:
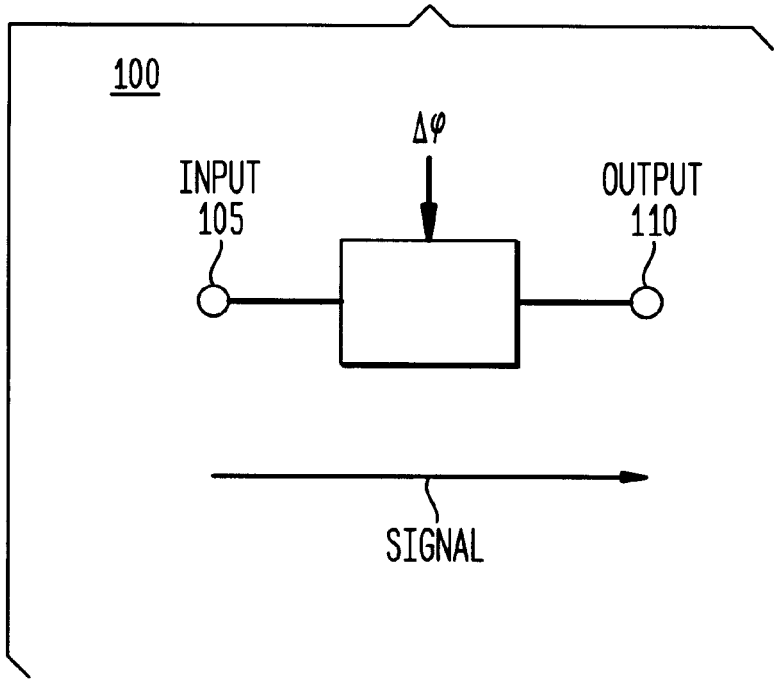
FIG. 1*a* is a transmission mode phase shifter.

Referring to FIG. 1*a*, a phase shifter 100 is used as a two port device in most applications. Port one 105 represents the signal input and port two 110 represents the signal output. The relative phase between both signals can be tuned. Such phase shifters shall be called transmission mode phase shifters.

Figure 1B:
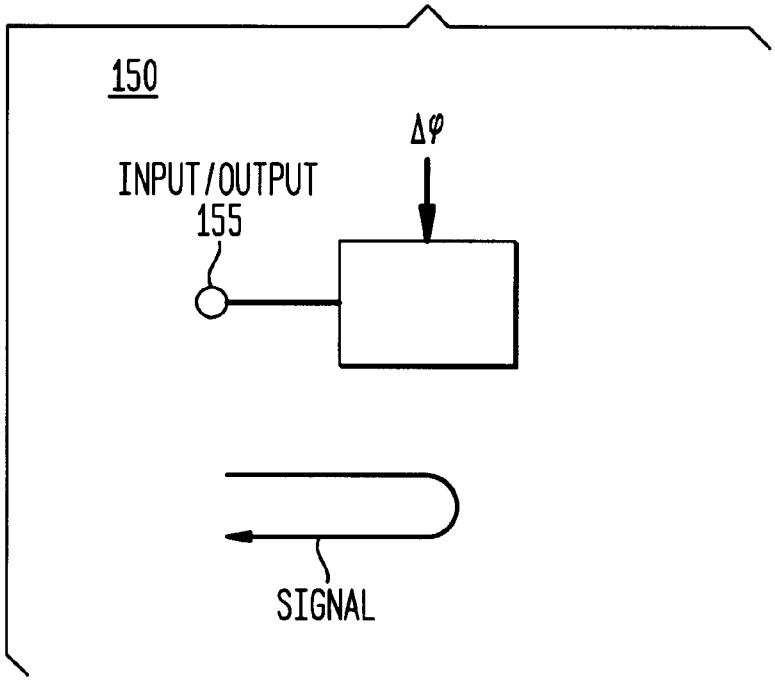
FIG. 1*b* is a reflection mode phase shifter.

Referring now to FIG. 1*b*, the basic phase shifter element of the invention, however, is a single-port device 150, where input signal and output signal share a common port 155. Such phase shifter elements shall be called reflection mode phase shifters. In order to convert a reflection mode phase shifter into a transmission mode phase shifter, incoming and outgoing signals have to be separated.

There are two principal mechanisms that achieve such a signal separation. One mechanism, based on break of time-reversal symmetry, is realized in a so-called circulator. The other mechanism, based on signal interference, can be realized in various fashions, e.g., by using backward couplers or quadrature hybrids ("QHD"). The latter devices will referred to as QHDs in the rest of the description without loss of generality.

Figure 2A:
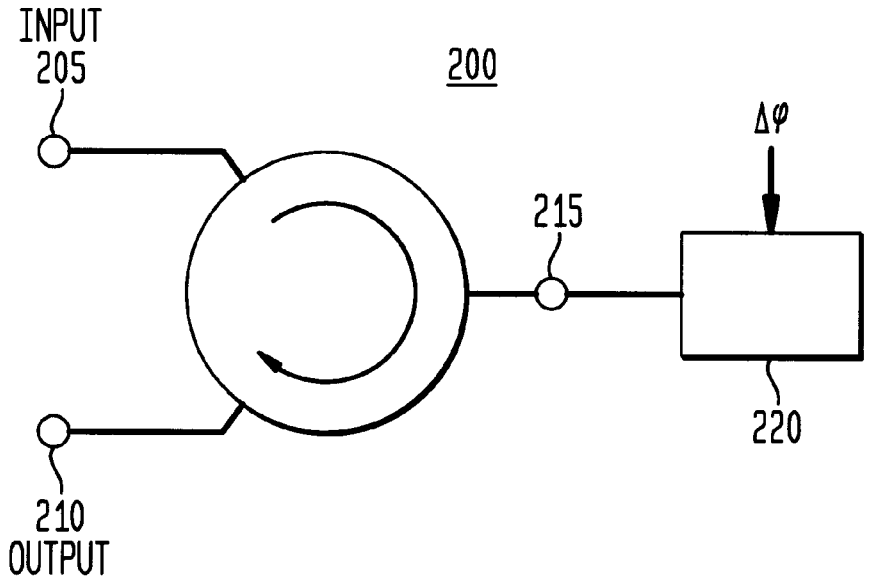
FIG. 2*a* is a reflection mode phase shifter with a circulator.
Figure 2B:
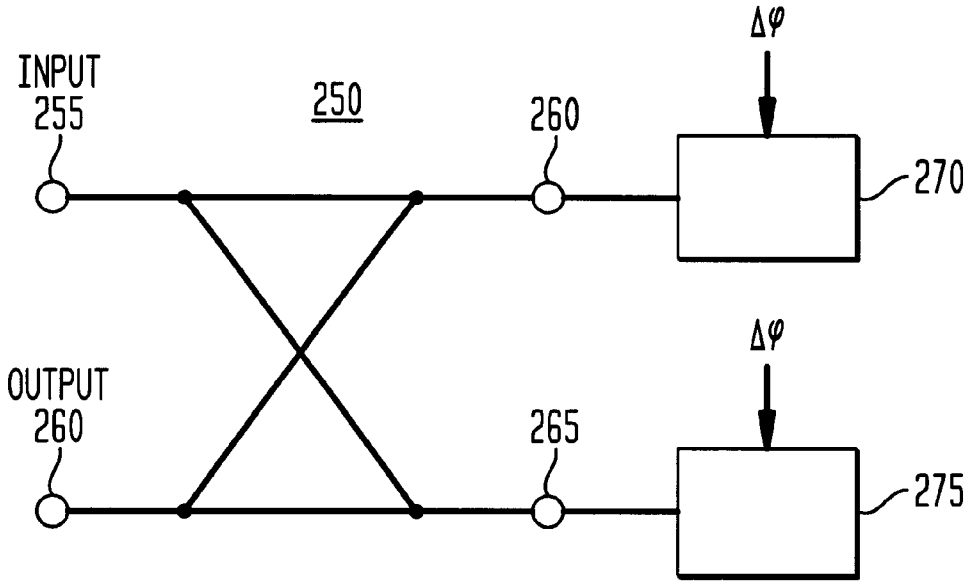
FIG. 2*b* is a reflection mode phase shifter with a quadrature hybrid.

Referring to FIGS. 2*a* and 2*b*, a circulator 200 is shown as a 3-port device and a QHD 250 is shown as a four port device. In the present case, two ports of either device (circulator or QHD) are used for signal input and signal output. These are noted as 205 and 210 for the circulator and 255 and 260 for the QHD. The other ports 215 and 260 and 265, respectively, are connected to reflection mode phase shifters 220 and 270 and 275, respectively. Therefore, one reflection mode phase shifter is needed in conjunction with a circulator, and two reflection mode phase shifters with a QHD. To guarantee a proper performance in the latter case, both single-port phase shifters have to be operated in unison, i.e., the phase, they are set to, should ideally be the same.

The employment of a QHD may appear more complicated than a circulator since two commonly driven reflection mode phase shifters are required instead of one. For the present application, however, the much higher power-handling capability, higher linearity and significantly lower cost of QHDs outweigh this disadvantage. As described herein, the required hardware overhead and adjustment are solved in an elegant fashion by the present invention.

Figure 3A:
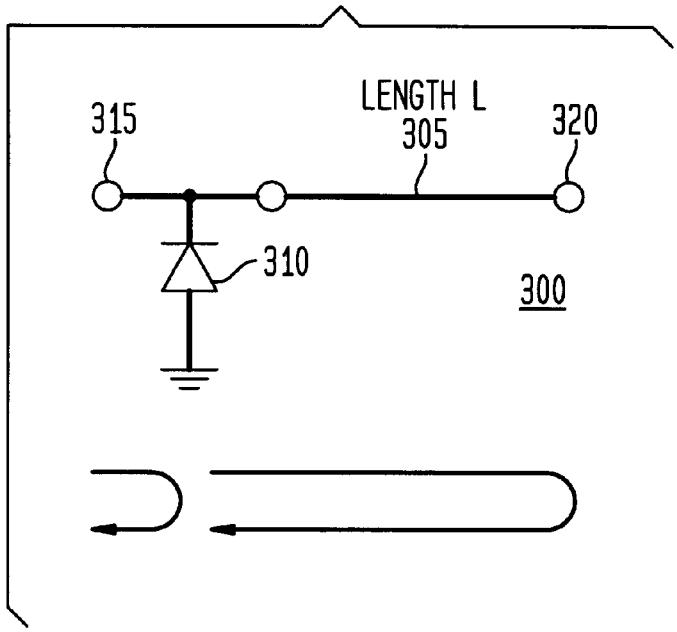
FIG. 3A (PRIOR ART)
FIG. 3*a* is a reflection mode phase shifter with a varactor diode and termination.

The realization of transmission mode phase shifters by using reflection mode phase shifters in conjunction with circulators or QHDs is common knowledge. Such implementation is used, e.g., for solid-state phase shifters. Referring to FIG. 3*a*, a reflection mode phase shifter element 300 consists of a transmission line 305 with length L that is shunted with a varactor diode 310 at a port 315 and terminated with an electrical open or short on a remaining end 320. As indicated by the arrows, a first part of the input signal is reflected at varactor diode 310, and a second part at termination end 320. Both reflected signals have different phase when arriving at port 315. A variation of the varactor capacitance alters the relative magnitude of both signals and therefore the phase of the total signal. However, as mentioned before, this type of phase shifter is limited in power-handling capability, has a high nonlinear response, and high insertion loss.

Figure 3B:
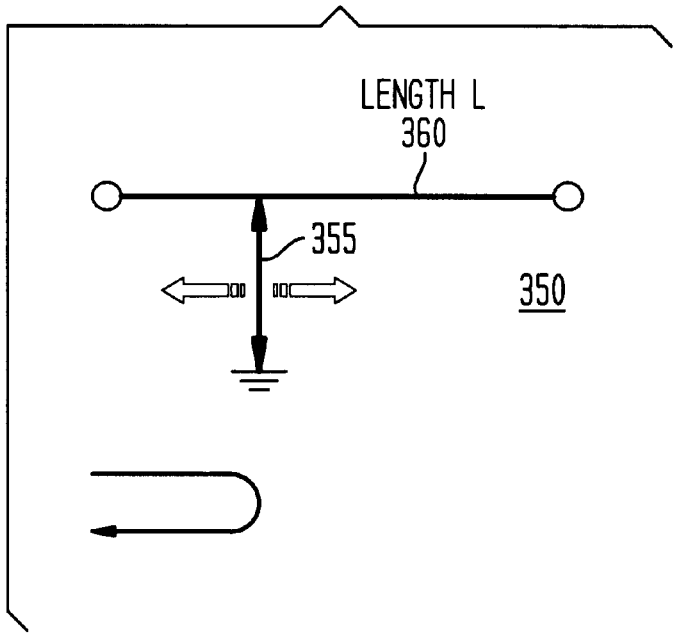
FIG. 3B (PRIOR ART)
FIG. 3*b* is a reflection mode phase shifter with a sliding short.

Referring to FIG. 3*b*, another realization of a reflection mode phase shifter 350 uses a movable sliding short 355. Phase shifter 350 consists of a transmission line 360 with movable sliding or electrical short 355. Shifting short 355 along line 360 determines the reflection point. The total phase change is given by twice the shifted electrical length. This phase shifter relies highly on the precise sliding electrical contact and is therefore prone to aging and corrosion.

Design of Reflection Mode Phase Shifter

The phase shifter of the present invention consists of two reflection mode phase shifter elements that operate in conjunction with a QHD-device, or, alternatively, a single reflection mode phase shifter element that operates in conjunction with a circulator. In the following discussion, reference is made only to QHD operated devices without loss of generality.

Reflection mode phase shifters and QHDs can be embedded in one common transmission-line structure. The basic design is compatible with most of the well-known transmission-line structures that propagate quasi-TEM modes. The following description, however, will focus on air-suspended stripline-structures first. Implementations for other quasi-TEM transmission-line types will be described afterwards. Moreover, since the implementation of QHD-circuits is common knowledge, the following discussion focus'mainly on the reflection mode phase shifter design and its physical implementation.

FIGS. 4*a*, 4*b*, 4*c*, 5*a*, 5, 5*c*, 5*d*, 6*a*, 6*b*, 6*c*, and 6*d* show the principal design of the proposed reflection mode phase shifter. In general, this reflection-mode phase shifter consists of an air-suspended stripline structure with impedance $Z_0$, a termination that represents an electrical short or an electrical open, and two conductive sledges that move in the upper and lower air-suspended region of the stripline between active line and ground. These sledges have no electrical contact to either the active line or ground, but the sledges fill a significant amount of the air gap between the active line and ground. They can further be moved in unison along the line.

The sledges build a capacitive shunt in the transmission line, which causes reflection of a significant part of the incoming signal. The remaining part is reflected by the open- or short-termination of the line, i.e., no power is lost. When the sledges are moved along the line, their reflection plane is moved with them, which therefore changes the phase of the total reflected signal.

Figure 4A:
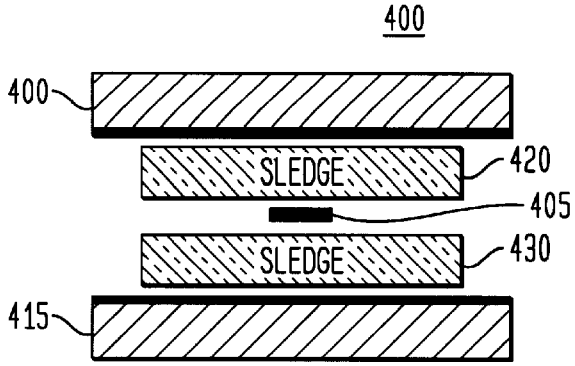
FIG. 4*a* is an end-cross sectional view of a phase shifter in an air-suspended stripline in accordance with the present invention.
Figure 4B:
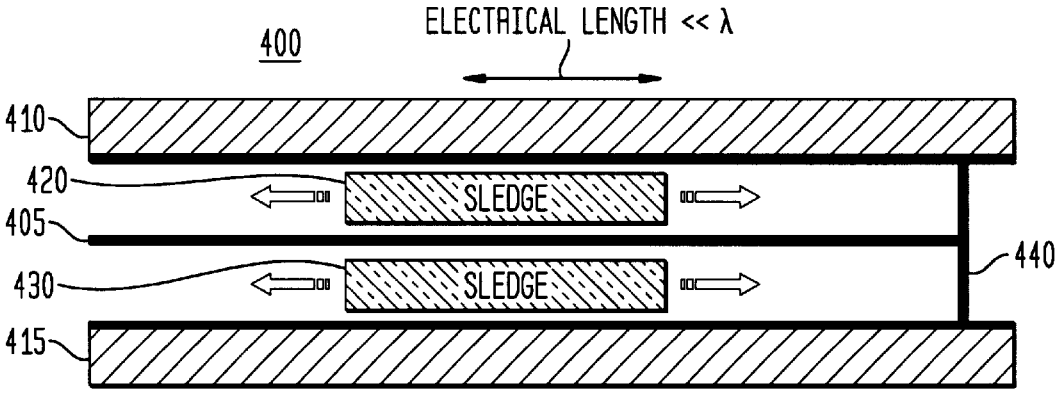
FIG. 4*b* is an side-cross sectional view of the phase shifter shown in FIG. 4*a;*

Referring specifically to FIGS. 4*a* and 4*b*, a reflection mode phase shifter in accordance with the invention is illustrated in end and side cross-sectional views. Reflection mode phase shifter 400 includes an air-suspended active line 405 and ground planes 410 and 415. Sledges 420 and 430 are deployed between active line 405 and ground plane 410 and active line 405 and ground plane 415, respectively. Termination is implemented by an electrical short 440 connected between active line 405 and ground planes 410 and 415. As shown, sledges 420 and 430 are not electrically connected to either active line 405 or ground planes 410 and 415 and are movable along active line 405.

Figure 4C:
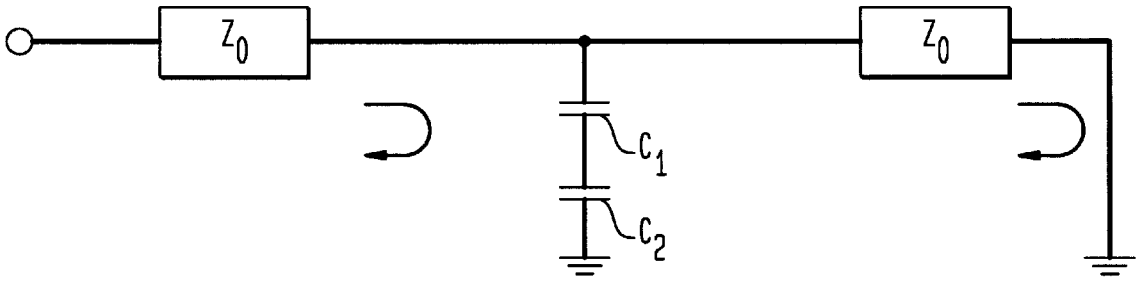
FIG. 4*c* is a circuit diagram of the phase shifter shown in FIGS. 4*a* and 4*b;*

Referring also to FIG. 4c, the signal reflection from sledges 420 and 430 can be understood in terms of equivalent circuits describing different limits of the actual physical realization. In this embodiment, sledges 420 and 430 are short compared to the wavelength of the propagating signal. In this limit, sledges 420 and 430 form two capacitances with active line and ground, $C_1$ and $C_2$, respectively. These two capacitances are in series, and they form a shunt capacitance $C_{tot}$ in the signal line:

$$C_{tot}=C_1C_2/(C_1+C_2)$$

Due to the significant of sledges 420 and 430, the air-gaps between active line to sledge, and sledge to ground plane are very small, and therefore $C_1$ and $C_2$ are very large. The reflection coefficient $\Gamma_{tot}$ from this shunt capacitance is:

$$\Gamma_{tot}=Z_c-Z_0/Z_c+Z_0 \text{ and } Z_c\ Z_0/(1+\omega C_{tot}Z_0)$$

where $Z_0$ is the impedance of the transmission line. As shown on Table 1, to get a significant reflection (i.e., tuning or phase shifting range), the shunt capacitance should be advantageously large: $\omega C_{tot}>1/Z_0$.

TABLE 1

Short Sledge Tuning Ranges

| $\omega C_{tot}Z_0$ | Max Tuning Range: |
|---|---|
| inf. | 360 deg |
| 10 | 315 deg |
| 5 | 273 deg |
| 3 | 226 deg |
| 2 | 180 deg |
| 1 | 106 deg |
| 0.5 | 46.3 deg |
| 0 | 0 deg |

Figure 5A:
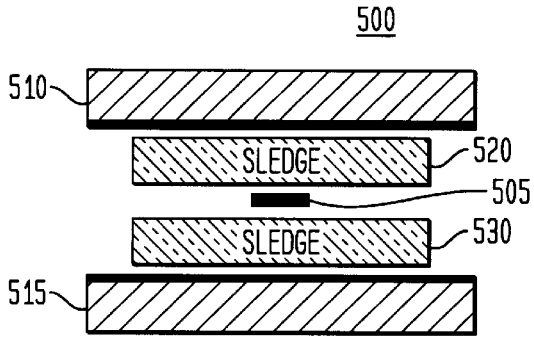
FIG. 5*a* is an end-cross sectional view of another phase shifter in an air-suspended stripline in accordance with the present invention.
Figure 5B:
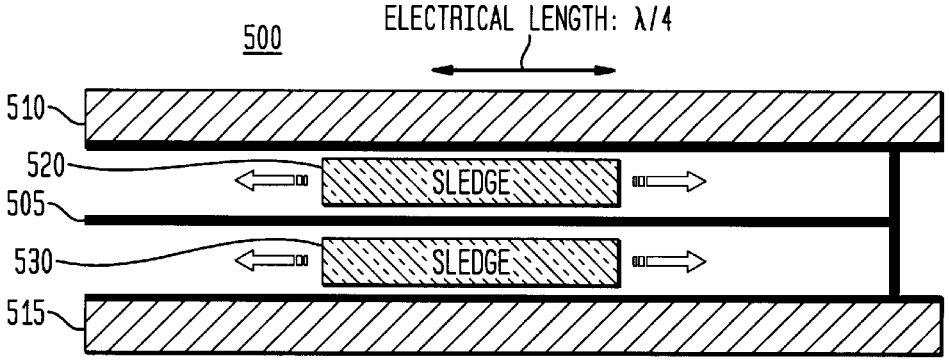
FIG. 5*b* is an side-cross sectional view of the phase shifter shown in FIG. 5*a;*
Figure 5C:
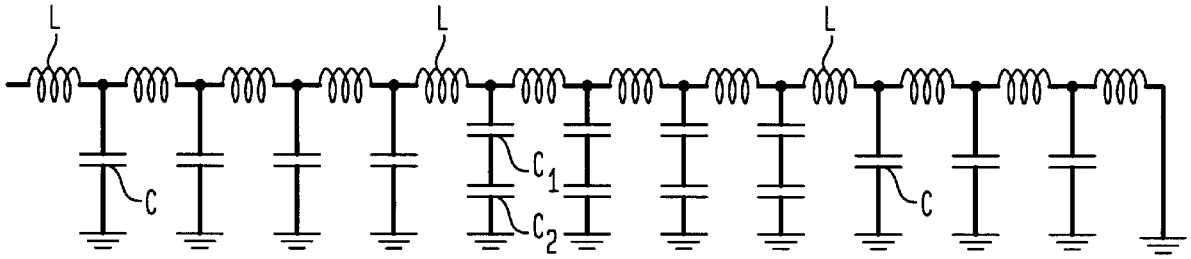
FIGS. 5*c* and 5*d* are circuit diagrams of the phase shifter shown in FIGS. 5*a* and 5*b;*
Figure 5D:
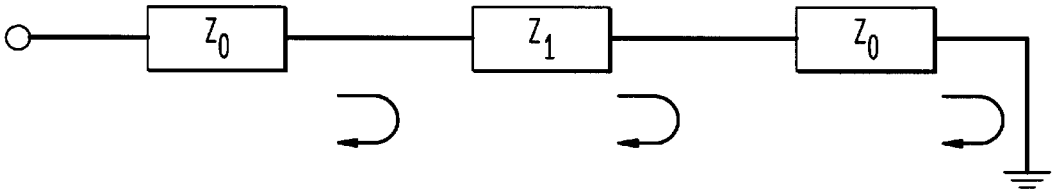

Referring now to FIGS. 5*a*, 5*b*, an embodiment of a reflection mode phase shifter 500 is shown that has longer sledges 520 and 530 between an air-suspended active line 505 and ground planes 510 and 515. When the sledges are longer, i.e., the signal phase varies significantly over their length, they are treated as part of the transmission line. As is known in the art air-suspended stripline has a particular capacitance C and inductance L per unit length, which determines its impedance $Z_0$:

$$Z_0=(L/C)^{1/2}$$

Here, the capacitance per unit length, C, is the capacitance density between active line 505 and both ground planes 510 and 515. The sledge suspended section of the transmission line has an increased capacitance density per unit length. As before, the capacitance C is split into 2 series capacitances, $C_1$ and $C_2$, now assigning capacitance densities between active line 505 and sledge 520 (530), and between sledge 520 (530) and ground 510 (515), respectively. Again, due to the significant thickness of sledges 520 and 530, the air-gaps between active line 505 to sledge 520 (530), and sledge 520 (530) to ground plane 510 (515) are very small, and therefore $C_1$ and $C_2$ are very large. The impedance in this section, $Z_1$, is roughly given by:

$$Z_1=(L/C_{tot})^{1/2},\ C_{tot=C1}C_2/(C_1+C_2)$$

The thickness of sledges 520 and 530 are regarded as additional inductance that is in series with $C_1$ and $C_2$. However, since the height of the stripline structure is usually small compared to X, this inductance is small and shall be neglected in this analysis. Since $C_{tot}$ is much larger than C, the impedance in the sledge suspended section is much smaller than in the air-suspended section.

An incoming signal-wave that travels along the air-suspended stripline, is reflected in part at this impedance step. The reflection coefficient $\Gamma_{01}$, is given by:

$$\Gamma_{01}=(Z_1-Z_0)/(Z_1+Z_0)$$

The fraction of the signal that is not reflected at this first interface, is traveling along the sledge-suspended line. When it approaches the next interface from sledge-suspended to air-suspended line, another partial reflection, $\Gamma_{10}$, occurs and is given by:

$$\Gamma_{10}=(Z_0-Z_1)/(Z_1+-Z_0)=-\Gamma_{01}.$$

where $\Gamma_{10}$ has the same magnitude as $\Gamma_{01}$, but different sign.

If the length of the sledges are chosen around one quarter of the guided wavelength, $\lambda/4=90^0$, the amplitudes of both reflected signals add coherently, and the total reflection coefficient of the sledges $\Gamma_{tot}$ undergoes a maximum, and is given by:

$$\Gamma_{tot-((Z1}-Z_0)/(Z_1+Z_0))^2$$

In real implementations, the magnitude of $\Gamma_{tot}$ will even be larger than given by this equation since the change of the field distribution at the interfaces will provoke additional reflection.

Figure 6A:
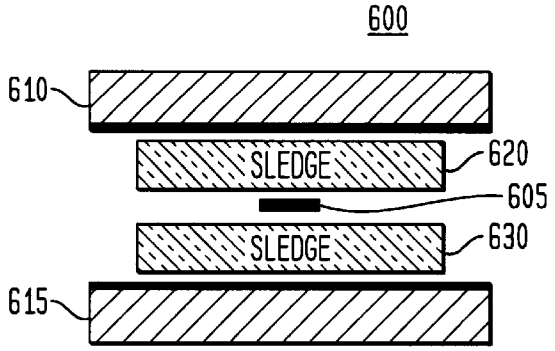
FIG. 6*a* is an end-cross sectional view of another phase shifter in an air-suspended stripline in accordance with the present invention.
Figure 6B:
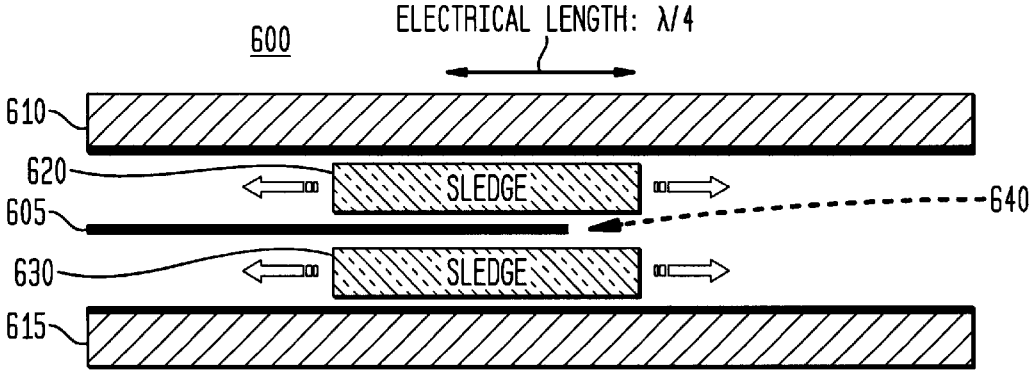
FIG. 6*b* is an side-cross sectional view of the phase shifter shown in FIG. 6*a;*
Figure 6C:
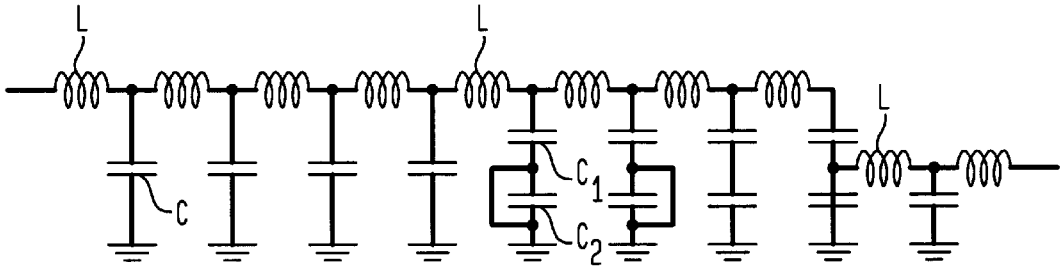
FIGS. 6*c* and 6*d* are circuit diagrams of the phase shifter shown in FIGS. 6*a* and 6*b;*
Figure 6D:
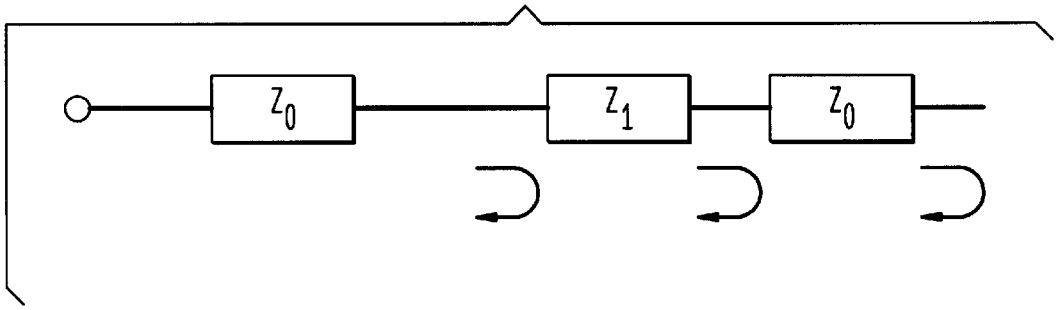

Referring to now FIGS. 6*a*, 6*b*, the above analysis is done with respect to an open termination configuration. Reflection mode phase shifter 600 in accordance with the invention is illustrated in end and side cross-sectional views. Reflection mode phase shifter 600 includes an air-suspended active line 605 and ground planes 610 and 615. Sledges 620 and 630 are deployed between active line 605 and ground plane 610 and active line 605 and ground plane 615, respectively. Termination is implemented by an electrical open 640.

In designs having an electrical open 640 at the end of active line 605, sledges 620 and 630 can be shifted over the line end. The corresponding response is more difficult to predict, since sledges 620 and 630 operate as active line beyond the electrical open. However, an electrical open might be easier and cheaper to implement than an electrical short.

The tuning range of phase shifter 400, 500 and 600 is given by the moving range of the sledges and by the magnitude of $\Gamma_{tot}$. However, since $\Gamma_{tot}<1$, the maximum tuning range can never exceed 360°. Table 1, presented previously, and Table 2 show the or the short-sledge limit and for a 90° sledge, respectively.

For a wide stripline and a $\lambda/4$-sledge, the impedance change from air-suspended to sledge suspended line can roughly be estimated. The impedance change is approximately given by:

$$Z_0/Z_1=(C_{tot}/C)^{1/2}=(1/(1-\text{fill factor}))^{1/2}$$

This relationship is based on the assumption that the capacitance is inversely proportional to the remaining air gap. The resulting fill factors are listed in the table. They show that a significant tuning range can be achieved with moderate fill factors.

TABLE 2

λ/4-sledge Tuning Ranges

| $Z_0/Z_1$ | Max Tuning Range: | Fill factor (wide line): |
|---|---|---|
| inf. | 360 deg | 100.0% |
| 10 | 314 deg, | 99.0% |
| 7 | 296 deg | 98.0% |
| 5 | 270 deg | 96.0% |
| 4 | 248 deg | 93.8% |
| 3 | 212 deg | 88.9% |
| 2.5 | 179 deg | 84.0% |
| 2 | 148 deg | 75.0% |
| 1.5 | 90 deg | 55.5% |
| 1 | 0 deg | 0% |

Figure 7A:
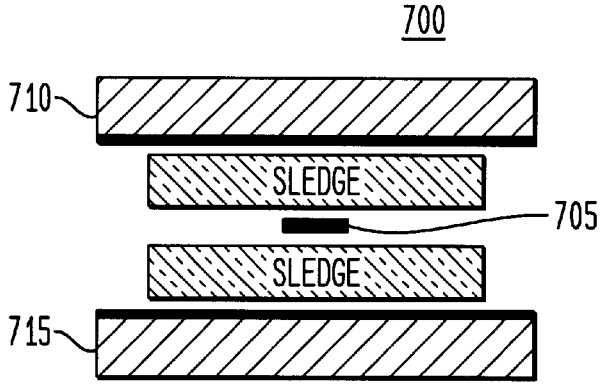
FIG. 7*a* is an end-cross sectional view of a multiple sledge structure in accordance with the present invention.
Figure 7B:
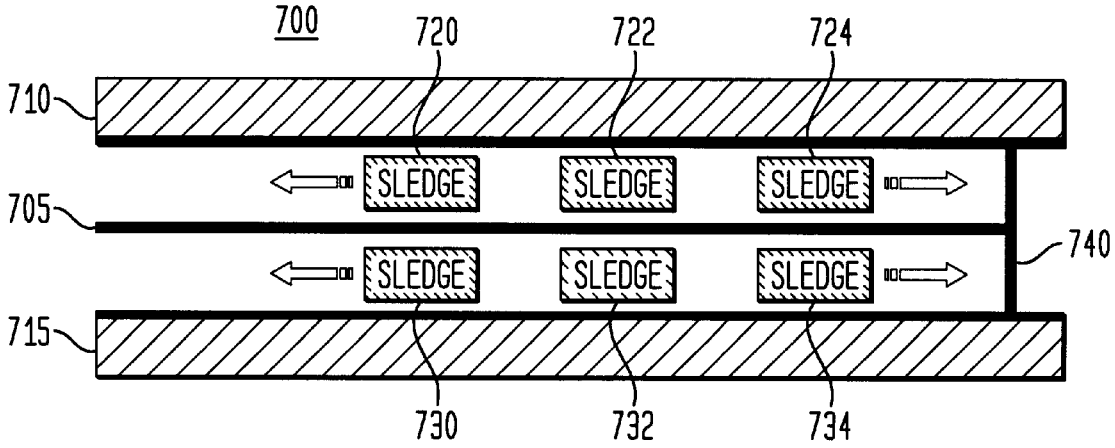
FIG. 7*b* is an side-cross sectional view of the phase shifter shown in FIG. 7*a;*

In addition to a short sledge and a λ/4-sledge, other sledge lengths and multiple sledge configurations are possible. These configurations have enhanced effects in terms of constructive interference. Referring to FIGS. 7*a* and 7*b*, a reflection mode phase shifter 700 in accordance with the invention is illustrated in end and side cross-sectional views. Reflection mode phase shifter 700 includes an air-suspended active line 705 and ground planes 710 and 715. As shown in FIG. 7*b*, multiple sledges 720, 722, 724 and 730, 732, 734. are deployed between active line 705 and ground plane 710 and active line 705 and ground plane 715, respectively. Termination is implemented by an electrical short 740.

Physical Implementation of Reflection mode Phase shifter

Figure 8A:
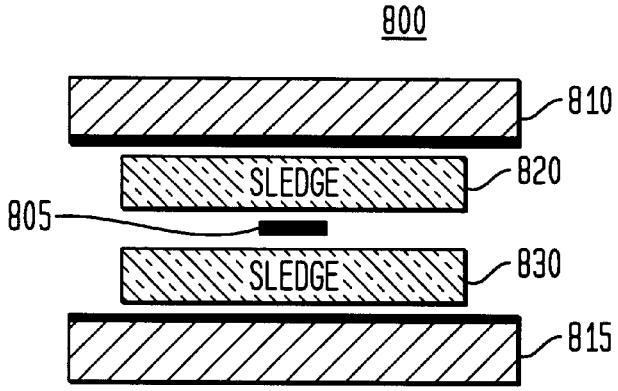
FIG. 8*a* illustrates one embodiment of the phase shifter in accordance with the present invention.

Referring to FIGS. 8*a*, 8*b*, 8*d* and 8*e*, there are shown end cross-sectional views of different embodiments of the reflection mode phase shifter of the invention. FIG. 8*a* illustrates an air-suspended stripline implementation of a reflection mode phase shifter 800. Phase shifter 800 has an active line 805 and ground planes 810 and 815. Sledges 820 and 830 are deployed between active line 805 and ground plane 810 and active line 805 and ground plane 815, respectively.

Figure 8B:
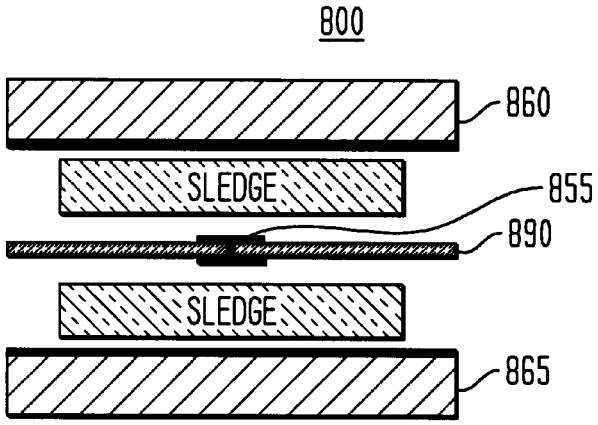
FIG. 8*b* illustrates a second embodiment of the phase shifter in accordance with the present invention.

Referring to FIG. 8*b*, an air-suspended stripline can be realized by supporting active line 855 on a thin circuit board 890 that is mounted in a center position between ground planes 860 and 865. It is advantageous to have the active line double-side printed on circuit board 890 in order to maintain full symmetry and to reduce the dielectric loss of circuit board 890. Additional vias (not shown) between both layers suppress potential excitation of differential modes.

Figure 8C:
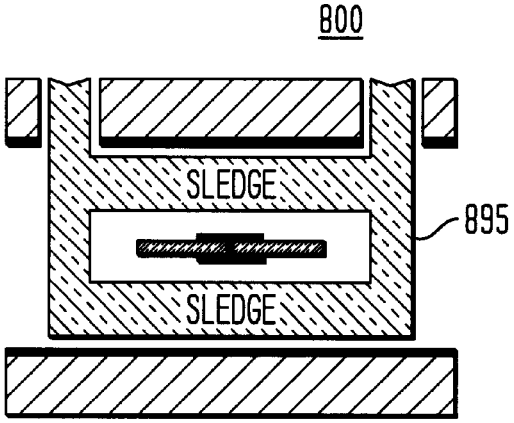
FIG. 8*c* illustrates a third embodiment of the phase shifter in accordance with the present invention.
Figure 8D:
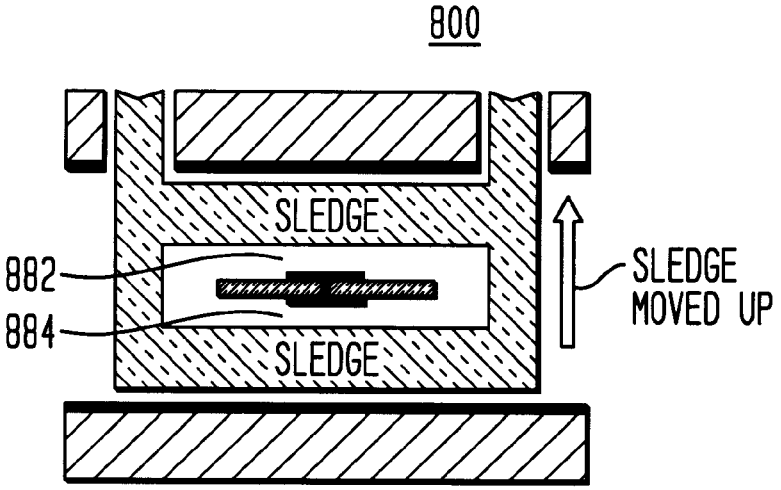
FIG. 8*d* illustrates another embodiment of the phase shifter in accordance with the present invention.
Figure 8E:
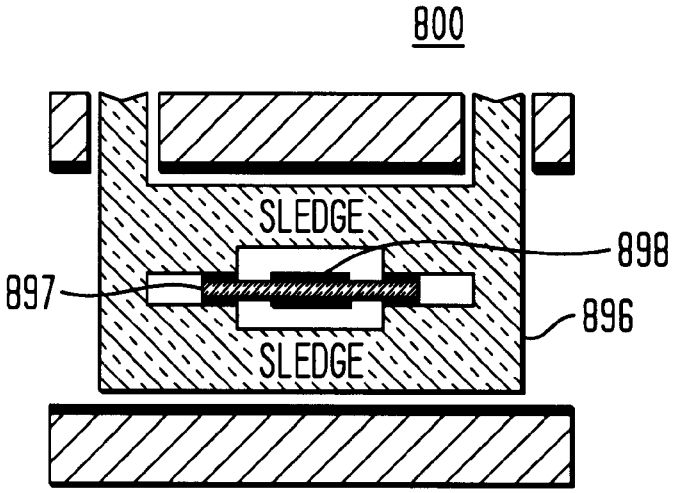
FIG. 8*e* illustrates still another embodiment of the phase shifter in accordance with the present invention.

The tolerances in the phase-response of the reflection mode phase shifter are mainly driven by uncontrolled vertical motion of the sledges. This affects the capacitance between sledge and line, or line and ground. Referring to FIG. 8*c*, a common rigid connection 895 between both sledges reduces this effect significantly. As illustrated in FIG. 8*d*, the vertical motion of such a double-sledge configuration in one direction results in an increased capacitance between the active line and sledge on side 882 and a decreased capacitance on side 884 of the active line. Both effects, however, result in first order cancellation.

Referring still to FIGS. 8*c* and 8*d*, common rigid connection 895 is implementable through slots in one of the ground planes. Obviously, this mechanical feed-through is placed in sufficient distance from the active line. It may be advantageous to make this connection non-conductive, so as to avoid signal leakage since the sledges carry active signal. Advantageously, common rigid connection 895 can be used for driving the sledges and can be attached to a stepping motor for remote control Referring to FIG. 8*e*, scratching of the active line is avoided by a simple tracking mechanism. This can be implemented as a self-centering sledge 896, that allows mechanical contact only with circuit board 897. Self-centering sledge 896 avoids contact with active line 898.

Sledge Implementation

Sledges are constructs of any materials that have sufficiently high conductance. Aluminum, for instance, is a perfect sledge material, that allows for easy machining, is light weight and has high conductance. As stated previously, the sledges slide between the ground plane and the circuit board. To avoid electrical contact with either ground or active line, the sledges can be coated with a thin layer of insulating material. Aluminum sledges, for instance, can be hard-coated (coating thickness of about 2 mils), resulting in a surface that is insulating, slightly lubricant, and mechanically stable against scratching. Since the dielectric constant of this coating is higher than 1, the capacitance $C_{tot}$ is further enhanced, increasing the tuning range.

The reflectance of the sledges is determined by its capacitance to active line and ground, by its length, and by the step in the field-distribution at the interface between the air-suspended and sledge-suspended line. Design alterations are possible that enhance one or several of these effects, such as capacitance enhancement by dielectric coating of the sledge, any length variation, multiple sledge structures, modifications of the sledge cross-section etc. Further, a restriction to usage of only one sledge is also possible.

Quadrature Hybrid and Other Device Implementations

As stated previously, the reflection mode phase shifter can be implemented with circulators, couplers and other quadrature hybrid designs etc. The reflection mode phase shifter element can function by itself or with any other circuit that allows for the separation of the in-going and reflected signal. Exemplary embodiments of quadrature hybrid and backward coupler devices are shown below.

Referring to FIGS. 9*a*, 9*b*, 9*c* and 9*d*, there are shown end and top cross sectional views of reflection mode phase shifters used in conjunction with a quadrature hybrid circuit (QHD). Advantageously, the same transmission-line structure 990 (e.g. air-suspended stripline) is used. Due to the small size of each phase shifter element, they can be attached in a straight-forward fashion to the QHD-circuit. QHD device 900 has an active line 905 supported by a circuit board 902 that is mounted in a center position between ground planes 910 and 915. As stated previously, two reflection mode phase shifters 920 and 930 are required for the four port QHD devices. Specifically, a first reflection mode phase shifter 920 has a double sledge structure positioned between active line 905 and ground plane 910 and active line 905 and ground plane 915, respectively, at port one 940. A second reflection mode phase shifter 930 is similarly placed at port two 950. Ports 960 and 970 are input and output ports of QHD device 900.

Figure 9A:
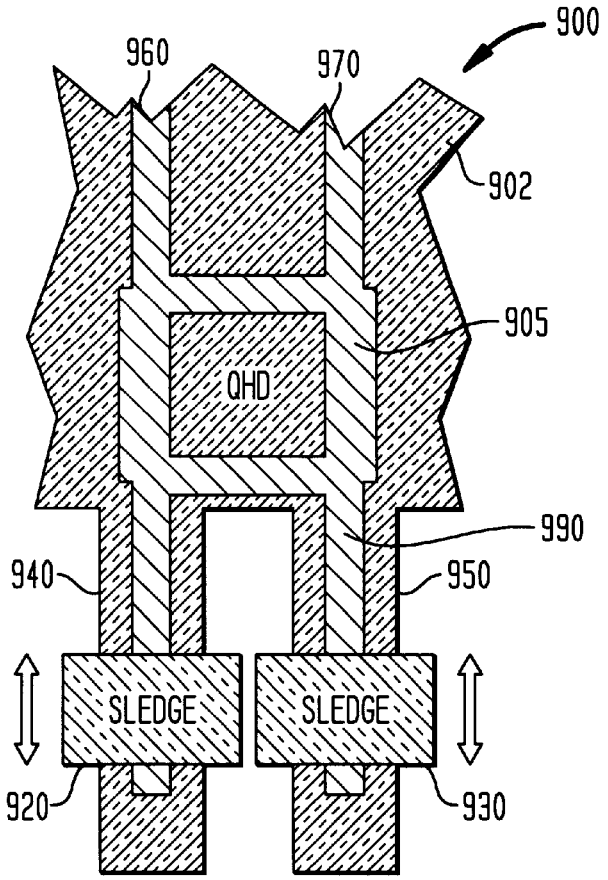
FIG. 9*a* illustrates an end cross-sectional view of one embodiment of the phase shifter used with a quadrature hybrid with two driving mechanisms in accordance with the present invention.
Figure 9B:
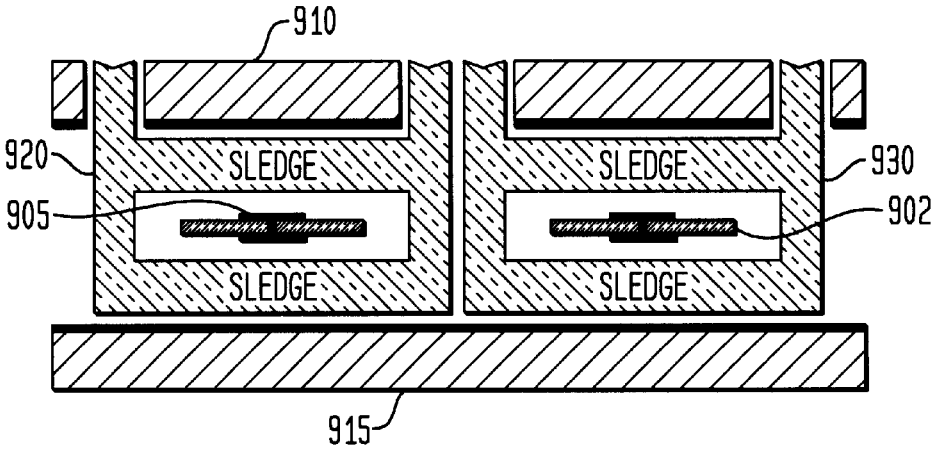
FIG. 9*b* illustrates a top cross-sectional view of the embodiment of the invention illustrated in FIG. 9*a*.
Figure 9C:
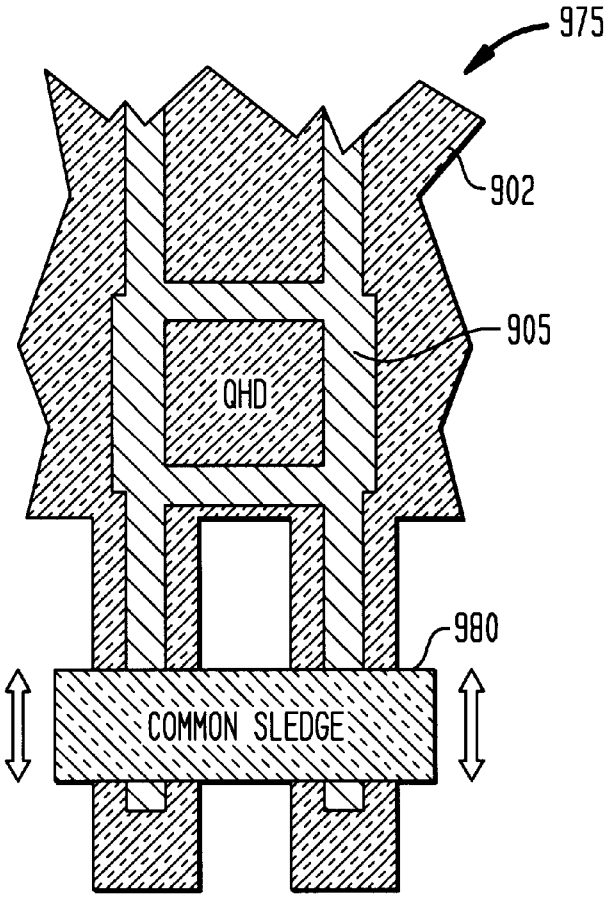
FIG. 9*c* illustrates an end cross-sectional view of another embodiment of the phase shifter used with a quadrature hybrid with one driving mechanism in accordance with the present invention.
Figure 9D:
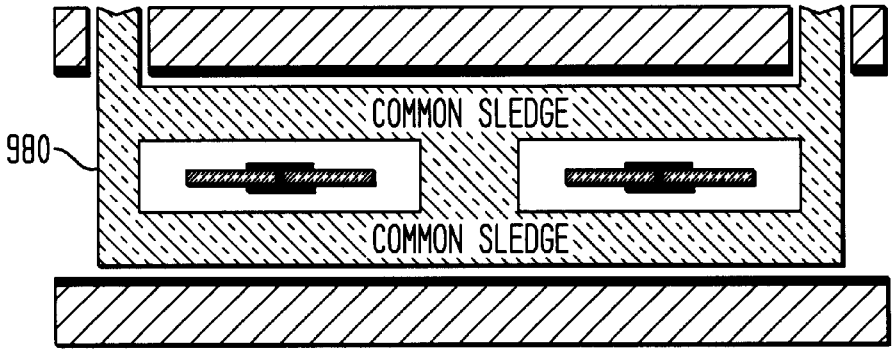
FIG. 9*d* illustrates a top cross-sectional view of the embodiment of the invention illustrated in FIG. 9*c;*
Figure 10A:
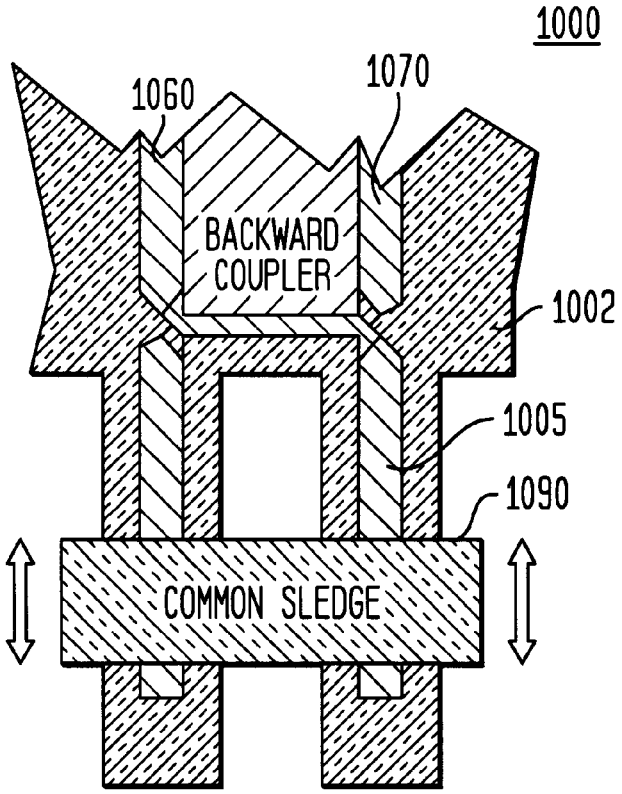
FIGS. 10*a* and 10*b* are top and end cross sectional views of phase shifters used with a backward coupler with a common driving mechanism, respectively.
Figure 10B:
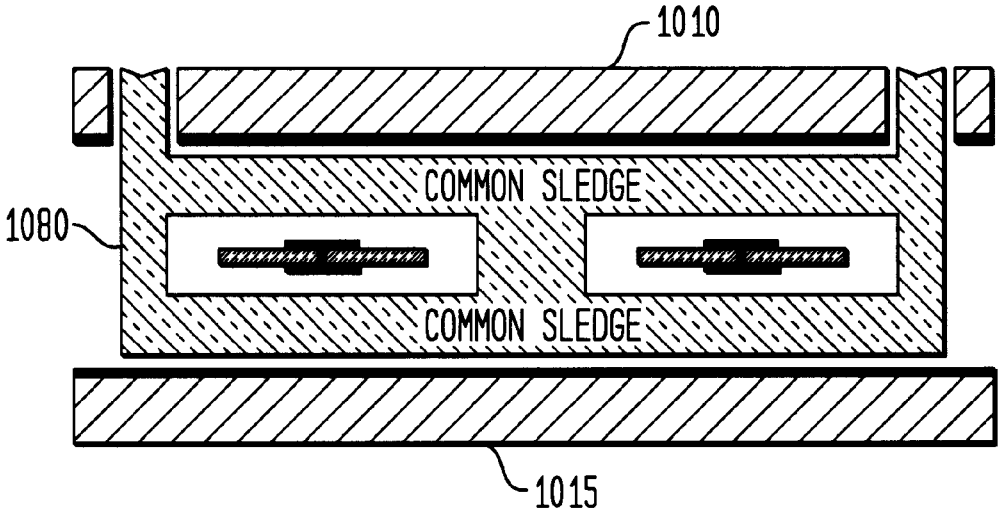
Figure 10C:
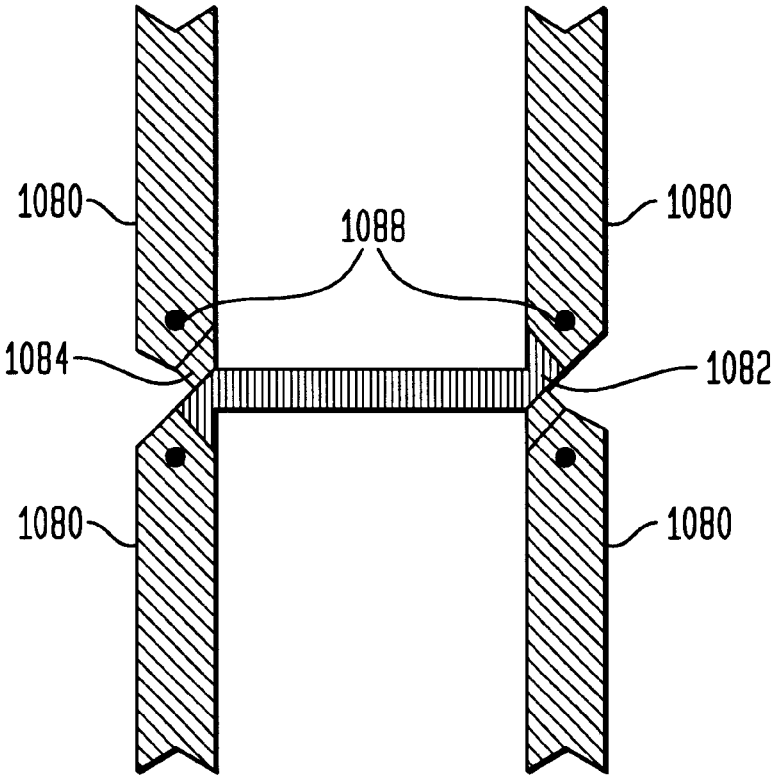
FIGS. 10*c* and 10*d* illustrate implementation aspects of the design shown in FIGS. 10*a* and 10*b;*
Figure 10D:
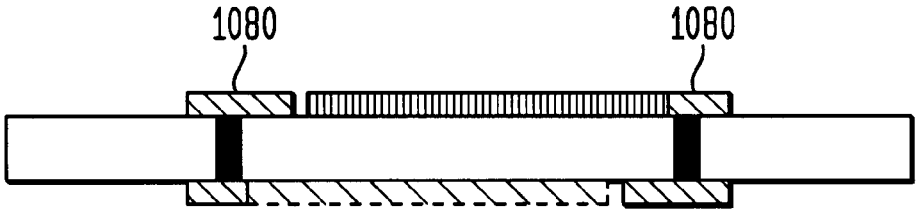

Referring now to FIGS. 9*c* and 9*d*, a uniform driving mechanism is shown with respect to a QHD device 975. To guarantee proper performance of the phase shifter with a QHD circuit, both reflection mode phase shifter elements have to be driven in unison. This can be arranged by connecting both double-sledges to one common rigid sledge 980. Since each sledge carries signal from the active line, cross coupling should occur between both QHD-branches. Simulations and measurements, however, have shown that this cross-coupling effect is of negligible magnitude (<−40 dB).

Referring to FIGS. 10*a*, 10*b*, 10*c* and 10*d*, there are shown end and top cross sectional views of reflection mode phase shifters used in conjunction with a backward coupler circuit. Backward coupler device 1000 has an active line 1005 supported by a circuit board 1002 that is mounted in a center position between ground planes 1010 and 1015. As stated previously, two reflection mode phase shifters are required for the four port backward coupler devices. In this case, a double sledge structure with a uniform driving mechanism 1090 is positioned between active line 1005 and ground plane 1010 and active line 1005 and ground plane 1015, respectively. Ports 1060 and 1070 are input and output ports of backward coupler device 1000. Structurally, an air-suspended stripline backward coupler has four ports represented by lines 1080 on a circuit board 1020. A top only layer 1082 and a bottom only layer 1084 extend between lines 1080. Since they overlap, signal power can couple from one line to the other and vice versa. Vias 1088 are positioned into each of the lines 1080 to avoid differential-mode excitations.

Figure 11A:
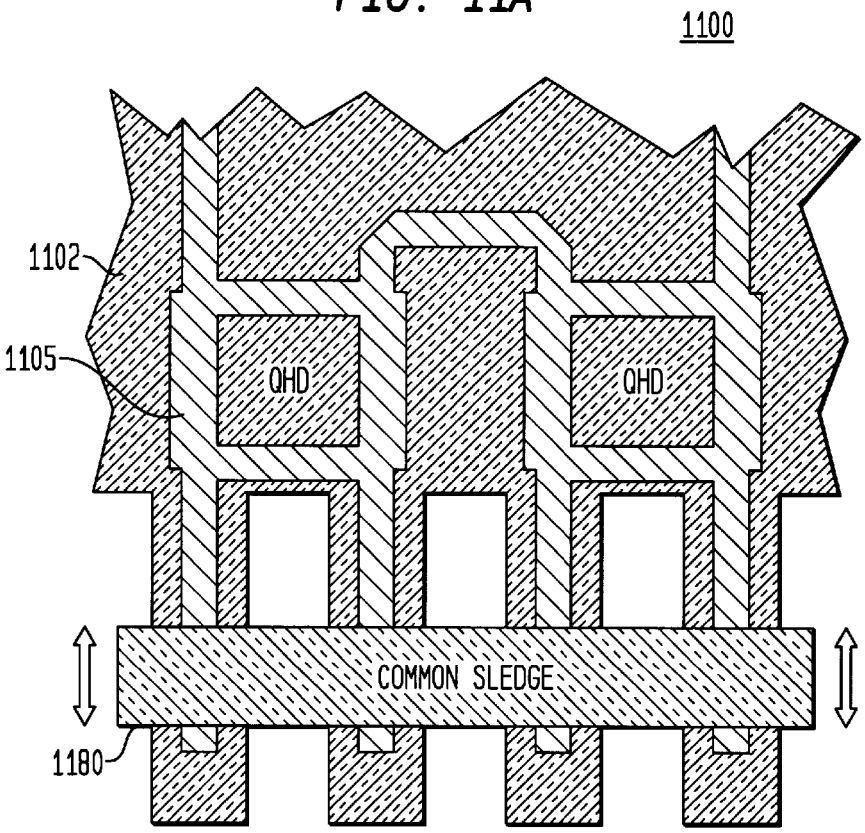
FIGS. 11*a* and 11*b* are top cross sectional views of series phase shifters used with a quadrature hybrid and backward coupler, respectively.
Figure 11B:
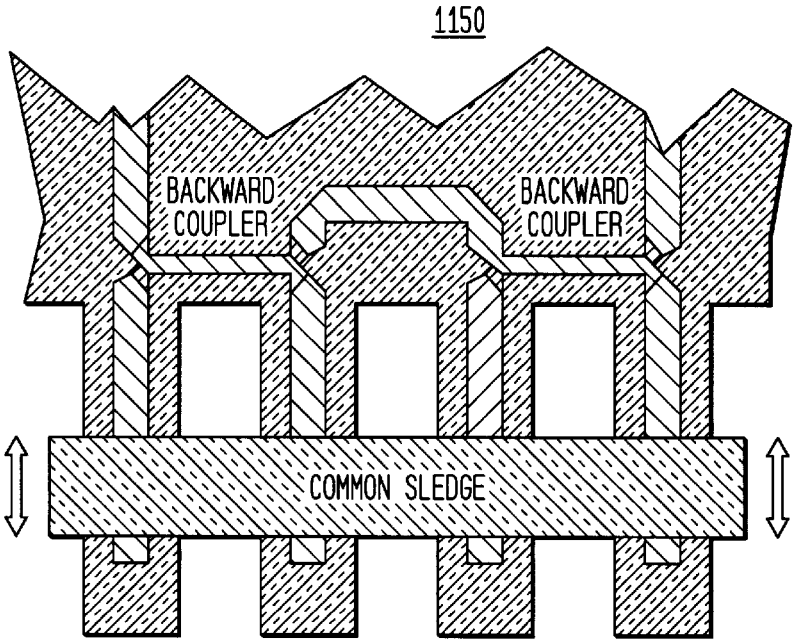
Figure 11C:
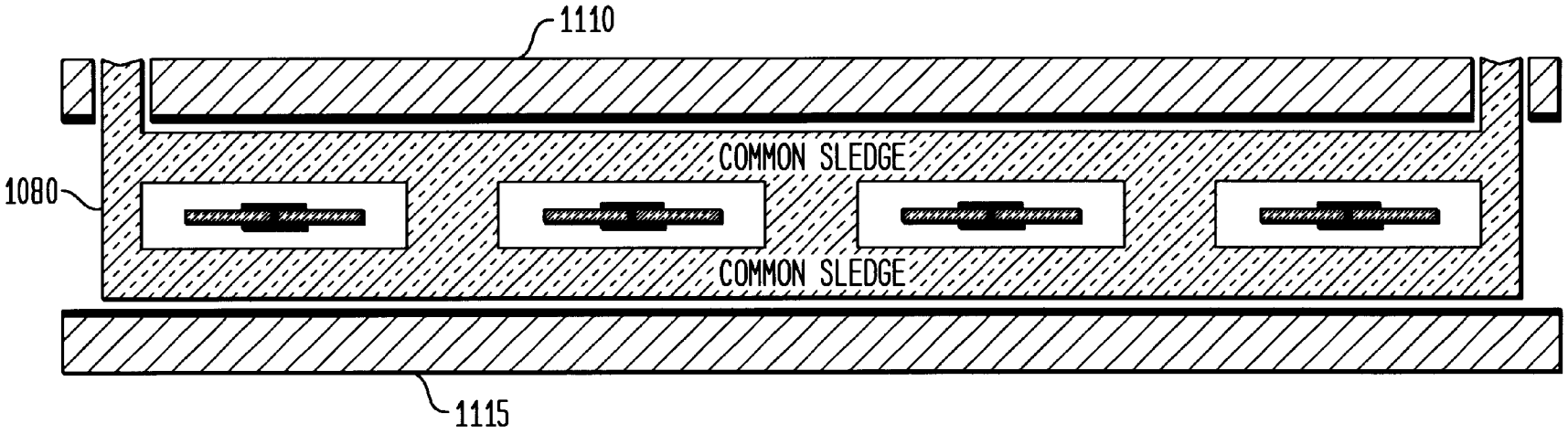
FIG. 11*c* is a cross sectional view of a series phase shifters with a common driving mechanisms for the sledges.

Referring to FIGS. 11*a*, 11*b* and 11*c*, there are shown end and top cross sectional views of reflection mode phase shifters used in conjunction with QHD and backward coupler circuits that have a collective driving mechanism for a series of phase shifters. QHD device 1100 has an active line 1105 supported by a circuit board 1102 that is mounted in a center position between ground planes 1110 and 1115. A series of double sledge structures connected with a common driving mechanism 1180 is positioned between active line 1105 and ground plane 1110 and active line 1105 and ground plane 1115, respectively. A similar configuration is shown for a backward coupler device 1150. Using two or more inventive phase shifters in series results in an enhanced tuning range. The sledges of all phase shifter elements can be coupled, as shown, such that only one actuator is required.

Alternative Transmission Line Structures

Although the air-suspended stripline was used as the exemplary transmission line structure, there are a multitude of variations to the current phase shifter design. They all exploit the same basic principle. Generally, any quasi-TEM transmission line allows for the use of a reflection mode phase shifter. The following are only illustrative.

Figure 12A:
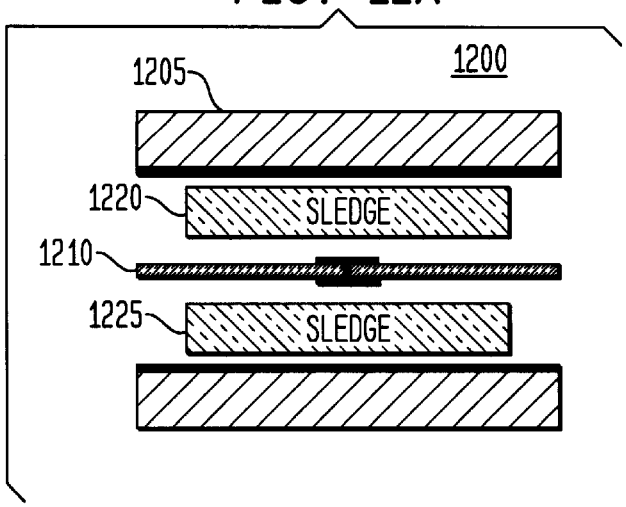
FIG. 12*a* illustrates an end cross-sectional view of an air-suspended phase shifter in accordance with the present invention.

Referring to FIG. 12*a*, the previously shown air-suspended stripline device 1200 is shown for comparison purposes. As shown, sledge 1220 is suspended Generally, air-suspended line implementations have the advantage that high impedance ratios, $Z_0/Z_1$, and high capacitance enhancements, $\omega C_{tot} Z_0$, can be achieved. If the major part of the field is confined to a circuit board, the sledges run only in the fringing field and the corresponding impact of the sledges is much smaller.

Figure 12B:
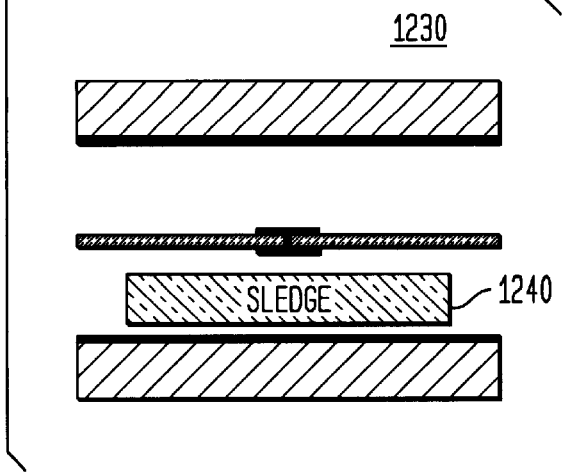
FIG. 12*b* illustrates an end cross-sectional view of an air suspended stripline (one sledge only) in accordance with the present invention.
Figure 12C:
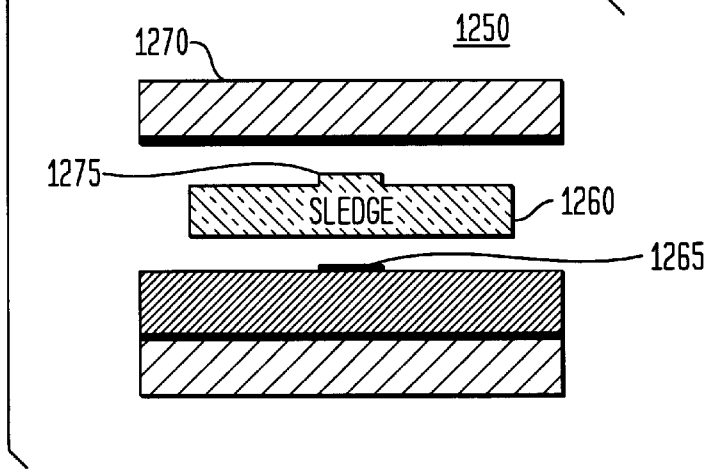
FIG. 12*c* illustrates an end cross-sectional view of a dielectric-suspended microstrip phase shifter in accordance with the present invention.

Besides air-suspended stripline structures many other transmission-line structures are compatible with the present phase shifter design. Referring to FIG. 12*b*, there is shown an air-suspended stripline device 1230 using one sledge 1240. A board-suspended microstrip device 1250 is shown in FIG. 12*c*. Sledge 1260 runs between active line 1265 and cover 1270 (ground). Sledge 1260 has a raised section 1275 to reduce sensitivity to the vertical motion of sledge 1260. Specifically, the asymmetric sledge design shown in FIGS. 12*c* and 12*e* results in similar field distributions between the active line and sledge and as between the sledge and ground. The capacitances are, therefore, the same. As vertical motion of the sledge reduces one capacitance and increases the other, cancellation occurs in the first order.

Figure 12D:
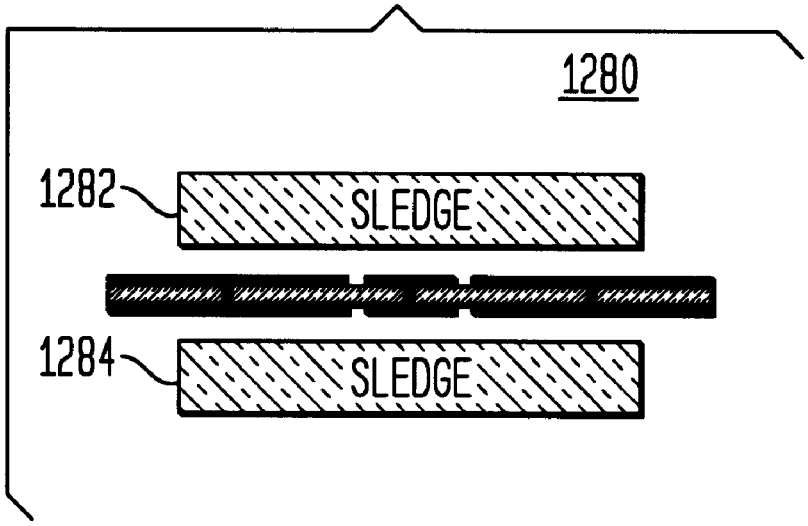
FIG. 12*d* illustrates an end cross-sectional view of an coplanar waveguide phase shifter in accordance with the present invention.
Figure 12E:
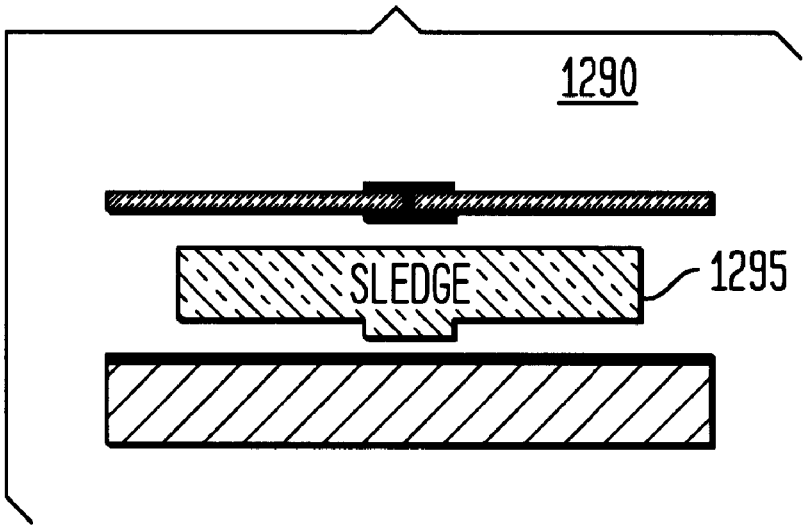
FIG. 12*e* illustrates an end cross-sectional view of an air-suspended microstrip phase shifter in accordance with the present invention.

FIG. 12*d* shows a coplanar waveguide device 1280. If laid out in a symmetric double-layer version, as shown, two sledges 1282 and 1284 can be used to achieve many of the advantages as shown above for air-suspended stripline 1200. Referring to FIG. 12*e*, there is shown an air-suspended microstrip device 1290 using one sledge 1295. An asymmetric form of sledge 1295 can help in this case to compensate for tolerances in the phase response due to the vertical motion of sledge 1295.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claim is reserved.

What is claimed is:

1. A device for phase shifting an incoming signal propagating through a transmission line having a capacitance distributed along its length, the transmission line having at least one active line and at least one ground that are disposed in a substantially parallel and spaced relation to one another, comprising:

the transmission line having a termination at one end thereof; and at least one conductive construct for sliding along the transmission line and capacitively coupling with at least one of the at least one active line and the at least one ground, wherein said at least one conductive construct behaves as a capacitive shunt reflecting a significant part of said signal and not reflecting a remaining part of said signal, said remaining part being coupled through said active line toward said termination and being reflected thereat.

2. The device according to claim 1, wherein said at least one conductive construct consist of two conductive constructs that form a double sledge construct with one driving mechanism.

3. The device according to claim 2, wherein said double sledge construct has a self-centering mechanism to prevent scratching of the at least one active line.

4. The device according to claim 1, wherein said at least one conductive construct has no direct electrical contact with the at least one active line and the at least one ground.

5. The device according to claim 1, wherein said at least one conductive construct fills a significant amount of gap between the at least one active line and the at least one ground.

6. The device according to claim 1, wherein local capacitance of the transmission line is enhanced at said capacitive shunt, said capacitive shunt acting as a discontinuity to reflect said significant part of the signal.

7. The device according to claim 1, wherein said capacitive shunt is a discontinuity that acts as at least one local capacitor to reflect said significant part of the signal.

8. The device according to claim 1, wherein said at least one conductive construct increases the capacitance of the transmission line over a significant line length, thereby providing a transmission line section with lower impedance that causes reflection at impedance discontinuities with respect to said transmission line section.

9. The device according to claim 8, wherein said transmission line section with lower impedance has an electrical length of ((n*180°)+90°) that maximizes signal reflection, wherein n is an integer.

10. The device according to claim 1, wherein larger phase shift ranges are achieved with higher values of capacitance for said capacitive shunt.

11. The device according to claim 1, wherein the transmission line is one selected from the group consisting of air-suspended stripline devices, board-suspended stripline devices, air-suspended microstrip devices, board-suspended microstrip devices, and coplanar waveguide devices.

12. The device according to claim 1, wherein, for a given active line and a given ground of said at least one active line and said at least one ground, a given construct of said at least one conductive construct is situated between said given active line and said given ground, wherein said given construct includes an outwardly extending protuberance.

13. The device according to claim 1, wherein, for a given active line and a given ground of said at least one active line and said at least one ground, a given construct of said at least one conductive construct is situated between said given active line and said given ground, said given construct having a longitudinal axis and being shaped to extend asymmetrically with respect to said axis.

14. The device according to claim 1, wherein said termination is one selected from the group consisting of an electrical short-circuit and an electrical open-circuit.

15. The device according to claim 1, wherein the at least one active line is a port of a circulator used to separate the incoming signal from said reflected significant part and said reflected remaining part of said signal.

16. The device according to claim 1, wherein the at least one active line is one port of a quadrature hybrid used to separate the incoming signal from a reflected outgoing signal, said quadrature hybrid further including a second port that is coupled to a second conductive construct.

17. The device according to claim 1, wherein the at least one active line is one port of a backward coupler used to separate the incoming signal from said reflected significant part and said reflected remaining part of said signal, said backward coupler further including a second port that is coupled to a second conductive construct.

18. The device according to claim 1, wherein a common driving mechanism is used to move more than one of said at least one conductive construct.

19. The device according to claim 1, wherein more than one of said at least one conductive construct are serially connected to enhance a phase shifting range.

20. The device according to claim 1, wherein said capacitive shunt provides a movable reflection plane and movement of said at least one conductive construct along the transmission line moves said reflection plane.

21. A reflection mode phase shifter, comprising:

a transmission line having a capacitance distributed along the length therof that has at least one active line and at least one ground plane that propagates a signal and has a termination at one end thereof; and at least one piece of material that has a conductive surface layer movable along said transmission line, said at least one piece of material capacitively coupling with one of said at least one active line and said at least one ground plane and thereby establishing an enhanced local capacitance at said transmission line, said enhanced local capacitance behaving as a discontinuity to reflect a significant part of the signal and not reflect a remaining part of the signal, the remaining part of the signal being coupled by said active line toward said termination.

22. The reflection mode phase shifter according to claim 21, wherein more than one of said at least one material are serially connected to increase a phase shifting range.

23. The reflection mode phase shifter according to claim 21, wherein said termination reflects said remaining part of the signal.

24. The reflection mode phase shifter according to claim 21, wherein movement of said at least one material along the transmission line moves a reflection plane thereof and thereby causes a phase shift in the signal.

25. The reflection mode phase shifter according to claim 21, wherein said discontinuity acts as a local capacitor to significantly reflect said signal.

26. The reflection mode phase shifter according to claim 21, wherein said at least one material increases the capacitance of the transmission line over a significant line length, thereby providing a transmission line section with lower impedance that causes reflection at impedance discontinuities with respect to said transmission line section.

27. The reflection mode phase shifter according to claim 26, wherein said transmission line section with lower impedance has an electrical length of ((n*180°)+90°) that maximizes signal reflection, wherein n is an integer.

28. The reflection mode phase shifter according to claim 21, a given piece of said at least one piece of material being situated between a given active line of said at least one active line and a given ground plane of said at least one ground plane, said given active line and given ground plane being disposed in a substantially parallel and spaced relation to one another, said given piece having a longitudinal axis and being shaped to extend asymmetrically with respect to said axis.

29. The reflection mode phase shifter according to claim 21, wherein a common driving mechanism is used to move more than one of said at least one conductive material.

30. A phase shifter for an incoming signal transmitted over a transmission line having a capacitance distributed along the length thereof, the transmission line having at least one active line, at least one ground and a termination at one end thereof, said phase shifter comprising:

at least one reflection mode phase shifting unit, each having at least one conductive construct for sliding along the transmission line and capacitively coupling with at least one of the at least one active line and the at least one ground, wherein said at least one conductive construct behaves as a capacitive shunt and reflects a significant part of the signal and does not reflect a remaining part of the signal, said remaining part of the signal being coupled by said active line toward said termination and being reflected thereat; and a signal separation circuit coupled with said at least one reflection mode phase shifting unit for separating said incoming signal from the reflected significant part and the reflected remaining part of said signal.

31. The phase shifter according to claim 30, wherein said signal separation circuit and said reflection mode phase shifter use a common transmission line structure.

32. The phase shifter according to claim 30, wherein movement of said at least one conductive construct along the transmission line moves a reflection plane thereof and thereby causes a phase shift in the signal.

33. The phase shifter according to claim 30, wherein capacitance of the transmission line is enhanced at said capacitive shunt, said capacitive shunt acting as a discontinuity to reflect said significant part of the signal.

34. The phase shifter according to claim 30, wherein said at least one conductive construct increases the capacitance of the transmission line over a significant line length, thereby providing a transmission line section with lower impedance that causes reflection at impedance discontinuities with respect to said transmission line section.

35. The phase shifter according to claim 34, wherein said transmission line section with lower impedance has an electrical length of ((n*180°)+90°) that maximizes signal reflection, wherein n is an integer.

36. The phase shifter according to claim 30, a given active line of said at least one active line and a given ground of said at least one ground being disposed in a substantially parallel and spaced relation to one another, a given construct of said at least one conductive construct being situated between said given active line and said given ground, said given construct having a longitudinal axis and being shaped to extend asymmetrically with respect to said axis.

37. The phase shifter according to claim 30, wherein a common driving mechanism is used to move more than one of said at least one conductive construct.

38. The phase shifter according to claim 30, wherein more than one of said at least one conductive construct are serially connected to increase a phase shifting range.

39. The phase shifter according to claim 30, wherein said signal separation circuit is one selected from the group consisting of circulators, backward couplers and quadrature hybrid devices.

* * * * *